US011534670B1

(12) United States Patent
Purciello

(10) Patent No.: US 11,534,670 B1
(45) Date of Patent: Dec. 27, 2022

(54) SPORTS STICK AND BALL PACKAGE

(71) Applicant: Franklin Sports, Inc., Stoughton, MA (US)

(72) Inventor: John F Purciello, Duxbury, MA (US)

( * ) Notice: Subject to any disclaimer, the term of this patent is extended or adjusted under 35 U.S.C. 154(b) by 49 days.

(21) Appl. No.: 17/205,430

(22) Filed: Mar. 18, 2021

(51) Int. Cl.
*A63B 59/70* (2015.01)
*A63B 60/06* (2015.01)
*A63B 102/24* (2015.01)

(52) U.S. Cl.
CPC ..... *A63B 59/70* (2015.10); *A63B 60/06* (2015.10); *A63B 2102/24* (2015.10)

(58) Field of Classification Search
CPC ..... A63B 59/70; A63B 60/06; A63B 59/02; A63B 53/04
See application file for complete search history.

(56) References Cited

U.S. PATENT DOCUMENTS 3,169,019 A * 2/1965 Genjack ..... A63B 59/20 D21/753
D260,488 S 9/1981 Kinneary
4,598,911 A * 7/1986 Lepera ..... A63B 69/3632 473/138
4,795,031 A 1/1989 Voss et al.
D329,377 S 9/1992 Cortelli et al.
D334,886 S 4/1993 Cortelli et al.
D339,060 S 9/1993 Cortelli et al.
D350,693 S 9/1994 Pratt
5,638,999 A * 6/1997 Greene ..... A63B 71/143 223/78
5,695,056 A 12/1997 Bender et al.
6,138,879 A * 10/2000 Breuner ..... A63B 43/02 223/78
8,066,590 B2 * 11/2011 Doherty ..... A63B 59/20 473/422
8,632,415 B1 * 1/2014 Smith ..... A63B 47/04 473/340
D750,972 S 3/2016 Fan
D751,417 S 3/2016 Fan
D751,418 S 3/2016 Fan
D752,994 S 4/2016 Fan
D806,531 S 1/2018 Fan
9,862,520 B2 1/2018 Fan
2005/0197205 A1 * 9/2005 Hale, Jr. ..... A63B 67/002 473/340
2005/0288131 A1 * 12/2005 Goldberg ..... A63B 59/30 473/505
2009/0069127 A1 * 3/2009 James ..... A63B 69/0091 473/422

(Continued)

*Primary Examiner* — Eugene L Kim
*Assistant Examiner* — Christopher Glenn
(74) *Attorney, Agent, or Firm* — Joseph B Bowman

(57) ABSTRACT

A sporting goods merchandising display for a sports stick and ball package, as for playing the sports of ball hockey and lacrosse, wherein a sports ball having a diameter $D_1$ is captured between spaced apart circular holes, each having a diameter $D_2$ less than the diameter $D_1$, in an open-ended packaging sleeve removably locked at a fixed position on the sports stick. Such packaging combines the sports stick and ball to prevent separation while on display but permits tactile access to the product components by sporting goods customers. A purchaser can easily remove the packaging sleeve to separate the product components without the aid of a cutting instrument.

17 Claims, 7 Drawing Sheets

(56) References Cited

U.S. PATENT DOCUMENTS

| | | | | |
|---|---|---|---|---|
| 2013/0196794 | A1* | 8/2013 | Wheelbarger ..... | A63B 69/0091<br>473/422 |
| 2019/0388757 | A1* | 12/2019 | Francken ..... | A63B 59/70 |

* cited by examiner

SPORTS STICK AND BALL PACKAGE

STATEMENT REGARDING FEDERALLY SPONSORED RESEARCH OR DEVELOPMENT

The inventions described and claimed in this application were not made under federally sponsored research and development.

CROSS-REFERENCE TO RELATED APPLICATIONS

This application has no related applications.

BACKGROUND OF THE INVENTION

This invention relates to a merchandising display package for a sports stick and ball such as a hockey stick and street hockey ball. More specifically, this invention relates to a display package which locks together a sports stick and ball while permitting the consumer physical access to both sports stick and ball for assessing tactile features of the product.

Merchants frequently desire to combine associated products into a sports set. Examples include a hockey stick with a street hockey ball, as well as a lacrosse stick with a lacrosse ball. Boxes or blister packs are characteristically utilized to contain the sports ball and at least portions of the sports stick itself are combined in such packaging in an effort to prevent separation of the stick and ball. Blister packaging is good in preventing separation of the products but notoriously difficult to open for most consumers. In addition, typical packaging of sports stick and ball sets prevents the sporting goods shopper from actually handling the product to judge its tactile features and esthetic qualities.

Blister packaging of various sporting goods, including balls, are found in D329377, D334886, D339060, and D350693. Some of these examples permit limited tactile access to the products contained in the blister packs. The prior art also contains other types of packaging for sports balls wherein portions of the ball itself are exposed. These include 4795031, 5695056, 9862520, D260488, D750972, D751417, D751418, D752994, and D806531. However, none of the foregoing prior art patents relate to packaging a sports stick and ball.

The need therefore remains in the field of sporting goods merchandising display for a sports stick and ball package which addresses the problems inherent with such packaging systems. The primary objective of this invention is to meet this need.

SUMMARY OF THE INVENTION

More specifically, an object of the invention is to provide a sports stick and ball package to provide a sporting goods shopper with tactile access to both the sports stick and ball components of a displayed set in order to assess such features as texture and other esthetic qualities.

Another object of the invention is to provide a sports stick and ball package which positively locks together the components to prevent inadvertent separation.

Yet another object of the invention is to provide a sports stick and ball package of the character described which can be conveniently displayed in a sporting goods store or department on a hanger from a pegboard-type merchandising display;

A further object of the invention is to provide a sports stick and ball package of the character described which is equally adaptable to the merchandising display of hockey sticks and lacrosse sticks, together with associated hockey and lacrosse balls, as well as other sports stick and associated balls as may be developed in the field of sporting products;

An additional object of the invention is to provide a package for a sports stick and multiple balls having the characteristics as previously described herein.

A further object of the invention is to provide a sports stick and ball package of the character described wherein the packaging material containing the sports ball or balls can be easily removed by hand from the sports stick by the sporting goods purchaser in order to separate the ball or balls from the sports stick without the aid of a knife, scissors, or other cutting instruments.

In summary, an object of the invention is to provide a sporting goods merchandising display for a sports stick and ball package, as for playing the sports of ball hockey and lacrosse, wherein a sports ball having a diameter $D_1$ is captured between spaced apart circular holes, each having a diameter $D_2$ less than the diameter $D_1$, in an open-ended packaging sleeve removably locked at a fixed position on the sports stick. Such packaging combines the sports stick and ball to prevent separation while on display but permits tactile access to the product components by sporting goods customers. A purchaser can easily remove the packaging sleeve to separate the product components without the aid of a cutting instrument.

Other and further objects of the invention, together with the features of novelty appurtenant thereto, will appear in the course of the detailed description of the drawings.

BRIEF DESCRIPTION OF THE DRAWINGS

In the following description of the drawings, in which like reference numerals are employed to indicate like parts in the various views.

DETAILED DESCRIPTION OF THE DRAWINGS

Figure 1:
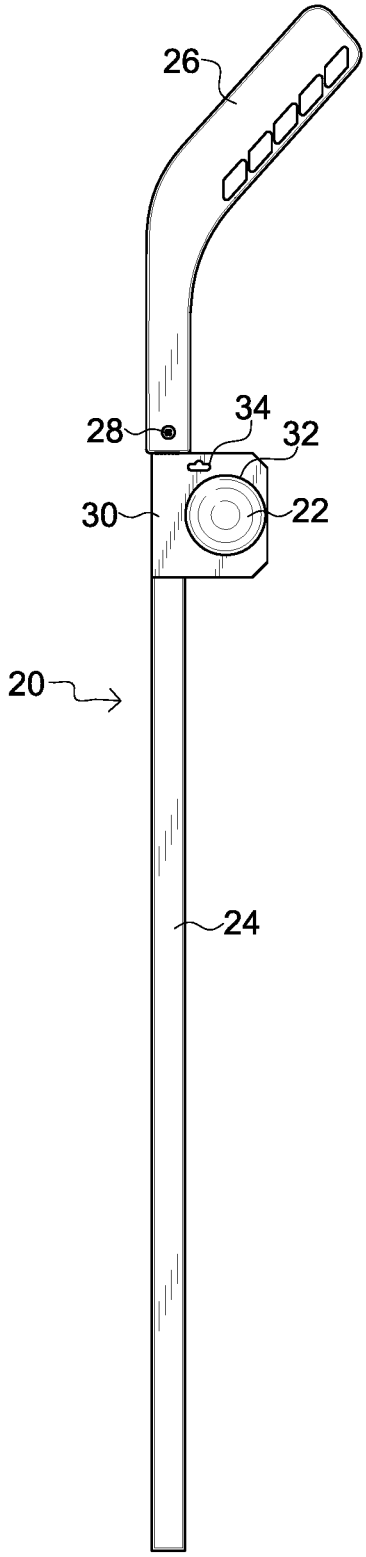
FIG. 1 is a side elevation view of a sports stick and ball package constructed in accordance with a first embodiment of the invention.

Referring to the invention in greater detail, attention is first directed to FIG. 1 illustrating a sporting goods merchandising display package for a hockey stick, designated generally by the numeral 20, and a hockey ball 22 having a uniform diameter $D_1$. The hockey stick 20 includes an elongate shaft 24 which is substantially rectangular in cross-section with slightly radiused edges. A removable hockey blade 26 is mounted on the proximal end of the shaft 24 and secured thereto with a mounting screw 28.

Beneath the hockey blade 26 is an open-ended, rectangular sleeve 30 having a portion thereof that wraps around and engages 3 sides of the shaft 24 and a portion that extends outwardly from the shaft 24 to capture the ball 22 between two spaced-apart circular openings 32 in the sleeve 30. The circular openings 32 have a diameter $D_2$ which is smaller than $D_1$ to prevent the ball 22 from being removed from the shaft 24 while being displayed for sale in a sporting goods business.

Figure 2:
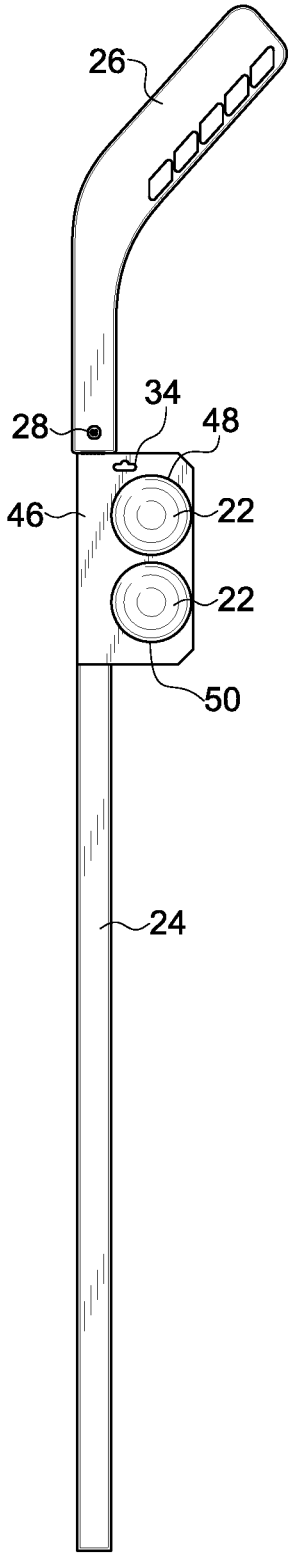
FIG. 2 is a side elevation view of a sports stick and two balls package constructed in accordance with a second embodiment of the invention.
Figure 8:
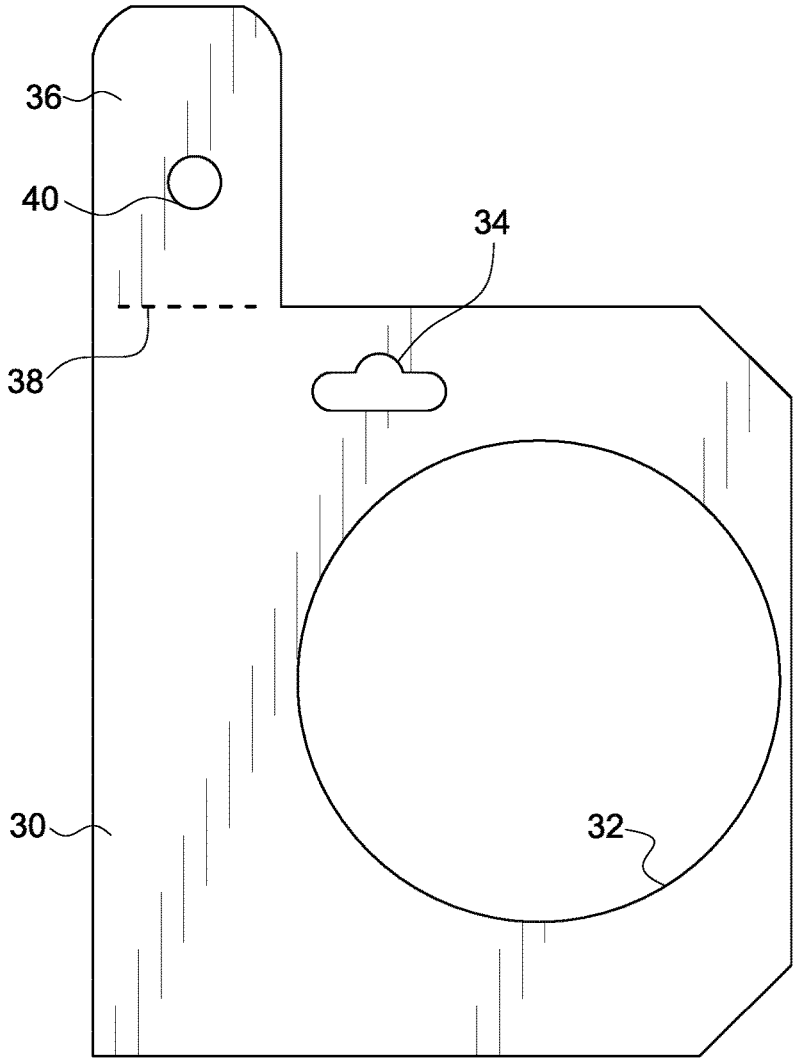
FIG. 8 is an enlarged, side elevational view of the packaging sleeve for receiving the sports ball to be mounted on the sports stick.
Figure 9:
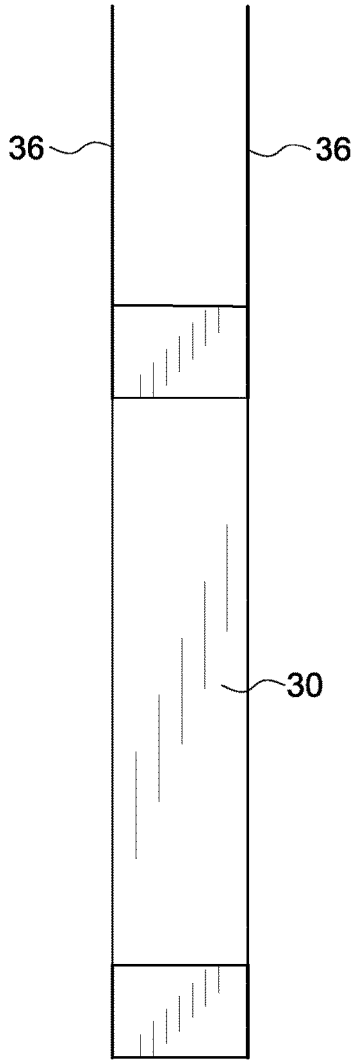
FIG. 9 is a front elevational view of the packaging sleeve for receiving the sports ball to be mounted on the sports stick.
Figure 10:
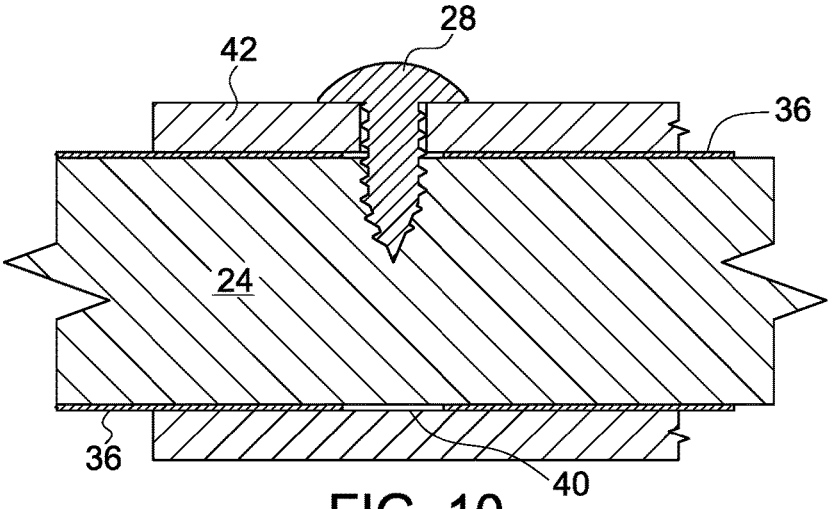
FIG. 10 is an enlarged fragmentary sectional view to illustrate a portion of the sports stick, a portion of the socket of the sports head, a portion of the locking tab from the ball containing sleeve, and the locking screw securing the sports head and ball containing sleeve to the sports stick.

The sizing of the sleeve 30 and the sizing and location of the openings 32 are critically important. For sizing of the sleeve 30, attention is focused on FIGS. 8 & 9. Sleeve 30 is preferably fabricated from thin, less than 0.5 mm thickness, but strong flexible material such as synthetic vellum or polyethylene terephthalate (a/k/a PET). If thicker materials, such as cardboards, are utilized, then inside dimensions of the sleeve 30 material should be referenced in the following. Ignoring the thickness of the material from which the sleeve 30 is fabricated, the width of the sleeve 30 or first cross-sectional dimension, as seen in FIG. 8, is substantially equal to the width of the shaft 24, as seen in FIGS. 1 & 2, plus the diameter $D_1$ of the ball 22. The depth of the sleeve 30 or second cross-sectional dimension, as seen in FIG. 9, is substantially equal to the depth of the shaft 24. The width and depth of the shaft 24 refer to the cross-sectional dimensions of the shaft 24 taken at an internal right angle, or otherwise perpendicular, to each other. The length (i.e., height in FIG. 8) of the sleeve 30 as a lower minimum that must at least equal the diameter $D_1$ of the ball 22. The length of the sleeve as shown in FIG. 8 is, of course, greater than the minimum. The extra surface area provides additional space for product imprinting. The extra length of the sleeve 30 proximal the hockey blade 26 includes a hanger portal 34, preferably located on the center of gravity of the product, so that the product 20 can be hung vertically and remain straight from a hanger bracket on a pegboard display in a sporting goods business.

As previously indicated, the sizing and location of the openings 32 in the sleeve 30 are also important. As to sizing, the diameter $D_2$ of the openings 32 optionally is equal to two time the square root of one half the diameter $D_1$ of the ball is optimally equal to two times the square root of 0.25 times the diameter $D_1$ of the ball 22 squared minus 0.25 times the second cross-sectional dimension of the sleeve 30 squared. As an example, the shaft 24 at the location beneath the hockey blade 26 where the sleeve 30 and ball 22 are to be mounted has a cross-sectional width of about 27 mm and a cross-sectional depth of about 17 mm. The ball diameter $D_1$ is approximately 66.7 mm. The sleeve 30 has a first cross-sectional dimension of 93 mm and a second cross-sectional dimension of 18 mm. Accordingly, the optimal diameter $D_2$ of the openings 32 is given by the following equation:

$$D_2=2\times\mathrm{SQRT}(0.25\times66.7\times66.7-0.25\times18\times18)=64.2\ \mathrm{mm}$$

The center of the opening 32 should be inwardly from the outside edge of the sleeve 30 a distance equal to half the diameter $D_1$ of the ball 22. This results in a small dimension of approximately 1.2 mm from the outside edge of the sleeve 30 to the edge of the circular opening 32.

With the foregoing dimensions of the sleeve 30, the perimeter is therefore equal to 222 mm. The circumference of the ball 22 is 209.5 mm so that flexure of the sleeve 30 permits the ball 22 to be inserted into one or the other of the open ends of the sleeve 30.

Referring further to FIG. 8 in the preferred embodiment of the invention, the sleeve 30 has a tab 36 extending from the upper edge of the sleeve 39 that overlies the width of the shaft 24. The tab 36 joins the edge of the sleeve 30 with a weakened severance line 38 provided by a series of small perforations. The tab 36 also includes a hole 40 therethrough to receive the locking screw 28 when the product is fully assembled.

Figure 3:
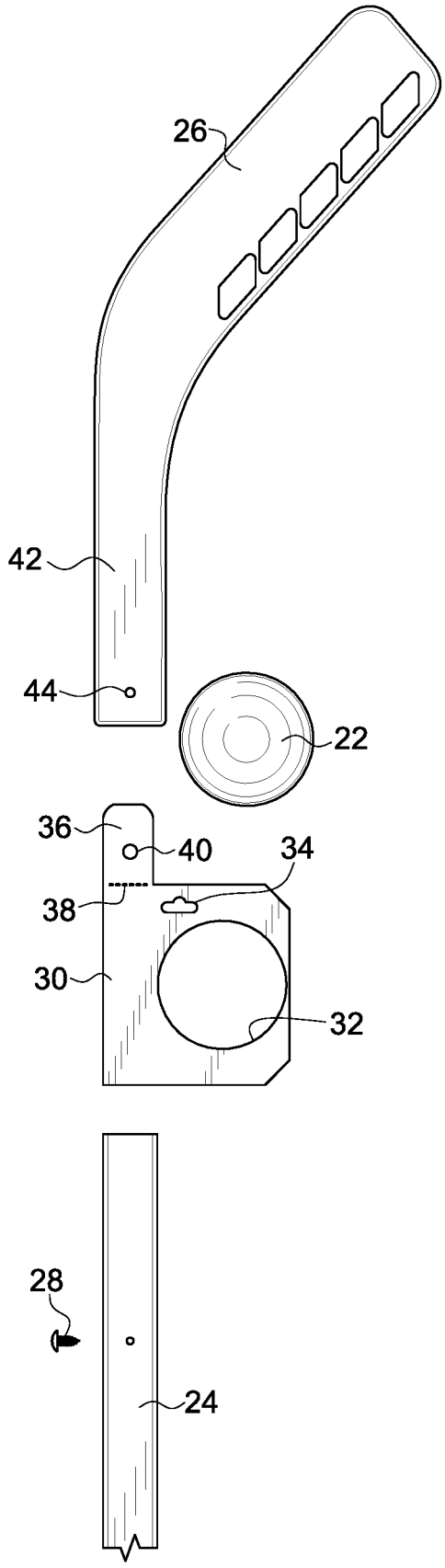
FIG. 3 is an enlarged, exploded view of the side elevation view of the sports stick and ball package as shown in FIG. 1.
Figure 4:
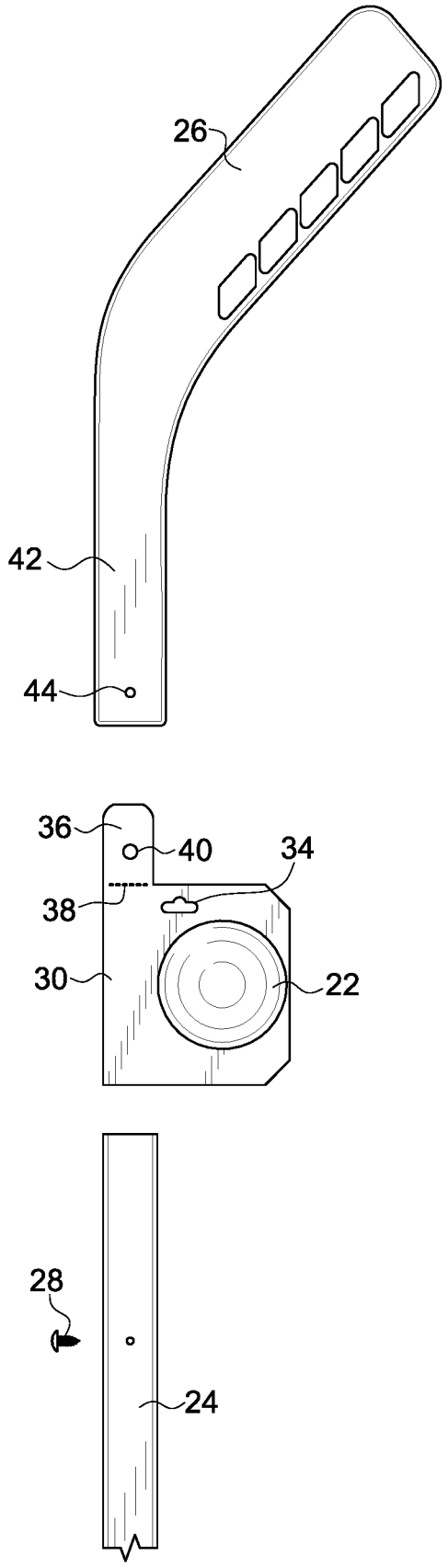
FIG. 4 is an enlarged, partially exploded view of the side elevation view of the sports stick and ball package as shown in FIG. 3 with the ball contained within the packaging sleeve.
Figure 5:
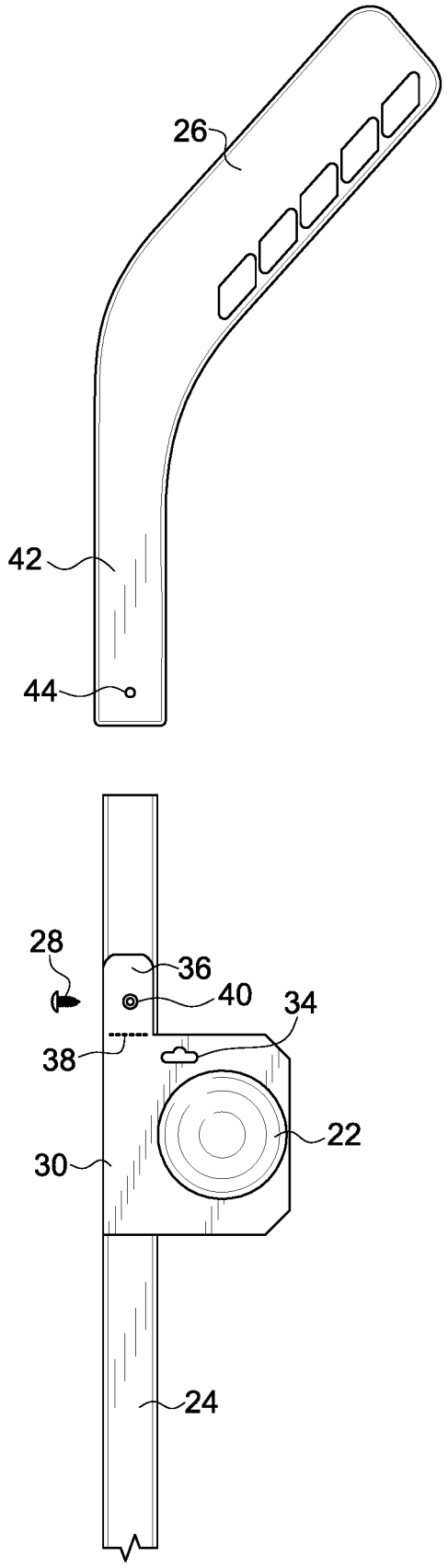
FIG. 5 is an enlarged, partially exploded view of the side elevation view of the sports stick and ball package as shown in FIG. 4 with the ball and associated packaging sleeve fitted onto the sports stick.
Figure 6:
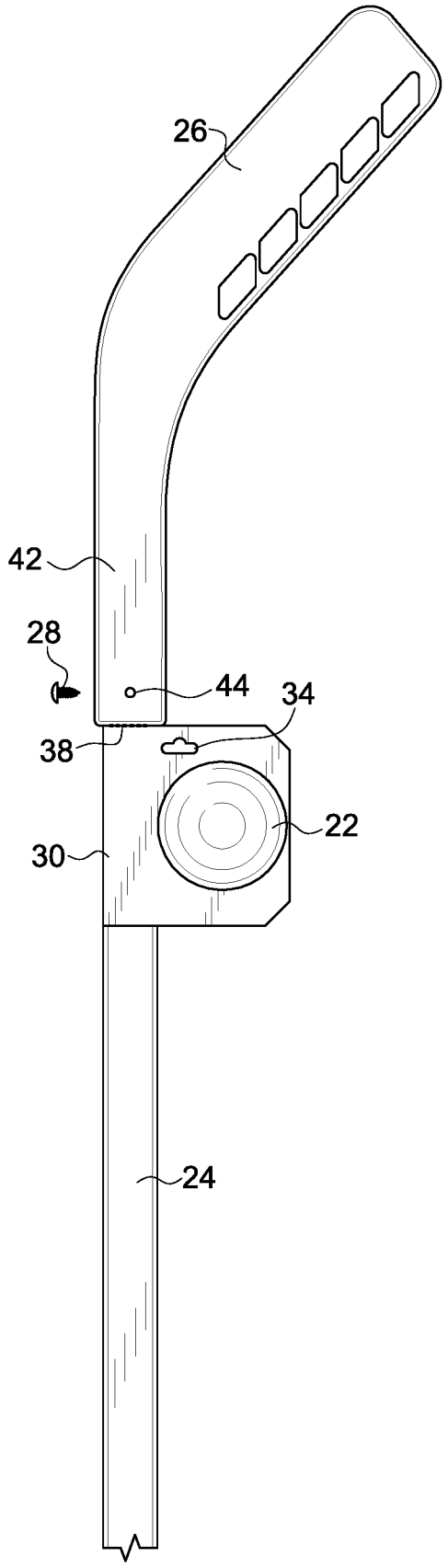
FIG. 6 is an enlarged, partially exploded view of the side elevation view of the sports stick and ball package as shown in FIG. 5 with the sports head fitted onto the sports stick prior to installation of a locking screw.
Figure 7:
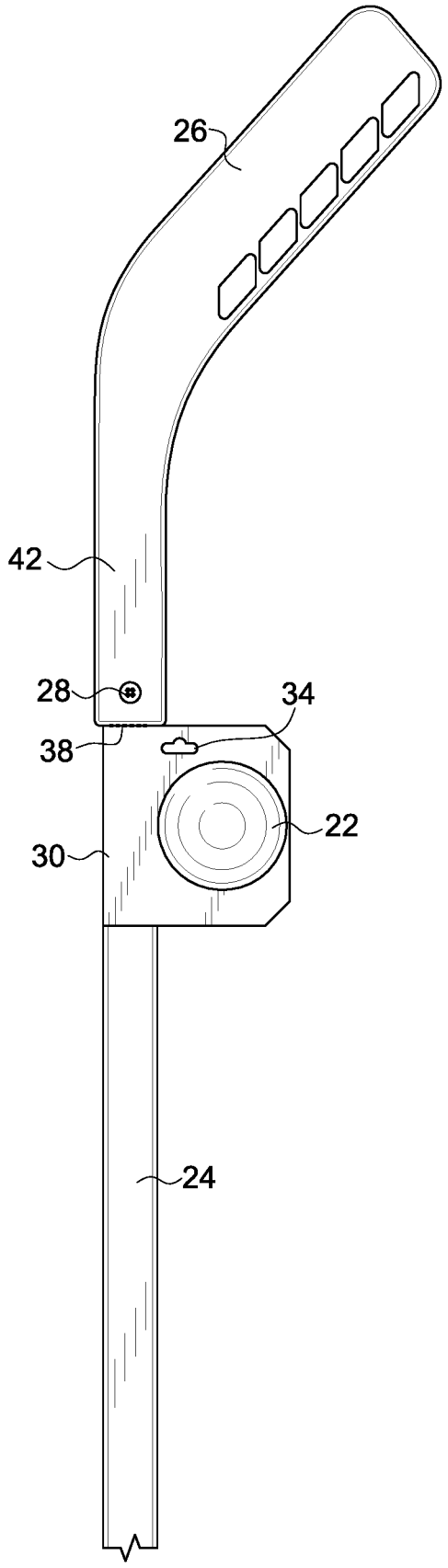
FIG. 7 is an enlarged, side elevation view of the fully assembled sports stick and ball package as shown in FIG. 6 with locking screw installed.

With respect to the assembly process, reference is made to the exploded views of FIGS. 3-7. FIG. 3 illustrates the fully exploded arrangement of the assembly parts. The ball 22 is first inserted into the sleeve 30 and captured within the openings 32 by flexing or ballooning out the sides of the sleeve 30 so that the ball 22 can be inserted from either open end of the sleeve 30. The assembled sleeve 30 and ball 22 is shown in FIG. 4. Next, the sleeve 30 and ball 22 assemblage in inserted onto the proximal end of the shaft 24 and positioned thereon where the assemblage is to be locked in place. This step is shown in FIG. 5. The open-end socket 42 of the hockey blade 26 is next fitted over the proximal end of the shaft 24 and also over the tab 36 so that the mounting hole 44 of the hockey blade 26 registers with the hole 40 of tab 36. The lower edge of the socket 42 of the hockey blade registers with the severance line 38 of tab 36. This step is shown in FIG. 6. Lastly, the locking screw 28 is installed into the shaft 24 through the mounting hole 44 of the hockey blade 26 to complete assembly as illustrated in FIG. 7. Enlarged detail of such connection is shown in Fog 10 and illustrates how the tab or tabs 36 are sandwiched between the interior surfaces of the socket 42 of the hockey blade 26 and the shaft 24.

It should be noted that the foregoing description relates to a mounting method for a replaceable hockey blade 26. In the event of wear or damage through use, the blade can easily be replaced. Alternatively, the hockey blade 26 can be glued or taped to the shaft 24 if a replaceable blade is not desired. Likewise, the sleeve 30 and ball 22 assemblage can be mounted to the shaft 24 by alternative methods other than tab 36.

However, with use of a tab 36 as described, removal of the sleeve 30 and ball 22 is easily accomplished without the aid of a cutting instrument or other tool. The purchasing consumer simply grasps the upper edge of the sleeve 30 above the ball 22 and pulls to separate the sleeve 30 from the tab 36 along the perforated severance line 38. The same action can be used on the opposite side of the sleeve 30 if two tabs 36 are present. The tab or tabs 36 simply remain hidden within the socket 42 of the hockey blade 26. The sleeve 30 and ball 22 assemblage can then be slipped off the end of the shaft 24 where the ball can be removed from the sleeve 30.

Circling back to FIG. 2, the same hockey stick construction as previously described is illustrated, but the sleeve 46 is sized to hold two balls 22 instead of one as was the case for sleeve 30, such that the upper ball 22 is inserted into an end of sleeve 46 and captured by the upper pair of spaced apart circular openings 48 in the first cross-sectional dimension of the sleeve. Similarly, the lower ball 22 is inserted into an end of sleeve 46 and captured by the lower pair of spaced apart circular openings 50 in the first cross-sectional dimension of the sleeve. The only change in sleeve 46, as distinguished from sleeve 30, is the overall length (i.e., height in FIG. 2). Sleeve 46 as a lower minimum length that must at least equal twice the diameters $D_1$ of the balls 22. The length of the sleeve as shown in FIG. 2 is, of course, greater than the minimum. The extra surface area provides additional space for product imprinting and for a hanger portal 34.

It will be understood to those skilled in the art of sporting goods merchandizing displays that the foregoing description of a hockey stick and ball can be equally adapted to other sports such as lacrosse. A lacrosse stick is typically octagonal in cross-section so that the first and second cross-sectional dimensions will be equal as opposed to the cross-sectional dimensions of a hockey shaft as previously described. However, the same calculations apply for the sleeve dimensions, ball hole size and hole location for a lacrosse ball which is slightly larger than a hockey ball.

From the foregoing it will be seen that this invention is one well adapted to attain all the ends and objects hereinabove set forth, together with the other advantages which are obvious, and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

Having thus described my invention, I claim:

1. A sports stick and ball package comprising:

a sports head adapted for playing a ball sport;

a sports ball having a diameter $D_1$;

an elongate shaft on which to mount said sports head, said shaft having a preselected position for mounting said sports ball, and at least first and second cross-sectional dimensions arranged at a right angle to one another at said preselected position for mounting said sports ball;

a rectangular flexible sleeve open at both ends and having first and second cross-sectional dimensions at said preselected position for mounting said sports ball and having a length between said ends greater than said diameter $D_1$ of said sports ball, said first cross-sectional dimension of said sleeve equal to said diameter $D_1$ of said sports ball plus said first cross-sectional dimension of said shaft, and said second cross-sectional dimension of said sleeve equal to said second cross-sectional dimension of said shaft;

a pair of parallel spaced apart circular openings in said first cross-sectional dimension of said sleeve, said openings having a diameter $D_2$ smaller than said diameter $D_1$ of said sports ball;

whereby said sports ball is inserted into an end of said sleeve and captured by said spaced apart circular openings, and said sleeve and ball are removable fixed to said elongate shaft at said preselected position for mounting said sports ball.

2. The sports stick and ball package as in claim 1, said pair of parallel spaced apart circular openings in said first cross-sectional dimension of said sleeve having a diameter $D_2$ equal to two times the square root of 0.25 times the diameter $D_1$ squared minus 0.25 times said second cross-sectional dimension of said sleeve squared.

3. The sports stick and ball package as in claim 2, said pair of parallel spaced apart circular openings in said first cross-sectional dimension of said sleeve having a diameter $D_2$ being positioned such that the centers of said circular openings are spaced inwardly from and perpendicular to said second cross-sectional dimension of said sleeve by a distance equal to one half said diameter $D_1$ of said sports ball.

4. The sports stick and ball package as in claim 1, said sports head selected from the group consisting of a hockey blade and a lacrosse head, and said sports ball selected from the group consisting of a hockey ball and a lacrosse ball.

5. The sports stick and ball package as in claim 1, said rectangular flexible sleeve being fabricated from thin sheet material selected from the group consisting of synthetic vellum, polyethylene terephthalate, and cardboard.

6. The sports stick and ball package as in claim 1, said sports head having a socket to receive said shaft, said preselect position for mounting said sports ball being directly beneath said socket, and said rectangular flexible sleeve further including a tab extension secured within said socket to lock said sports ball and sleeve at said preselect position on said shaft.

7. The sports stick and ball package as in claim 6, said tab extension being joined to said flexible sleeve by a perforated line of severance to permit removal of said sports ball and sleeve.

8. The sports stick and ball package as in claim 1, said sports head being a hockey blade, and said elongate shaft being rectangular in cross-section with said first cross-sectional dimension representing the width of said shaft and said second cross-sectional dimension representing the depth of said shaft.

9. The sports stick and ball package as in claim 1, said sports head being a lacrosse head, and said elongate shaft being octagonal in cross-section with said first cross-sectional dimension being equal to said second cross-sectional dimension.

10. A sports stick and ball package comprising:

a sports head adapted for playing a ball sport;

a pair of sports balls each having a diameter $D_1$;

an elongate shaft on which to mount said sports head, said shaft having a preselected position for mounting said pair of sports balls, and at least first and second cross-sectional dimensions arranged at a right angle to one another at said preselected position for mounting said pair of sports balls;

a rectangular flexible sleeve open at both ends and having first and second cross-sectional dimensions at said preselected position for mounting said pair of sports balls and having a length between said ends greater than twice said diameter $D_1$ of said sports balls, said first cross-sectional dimension of said sleeve equal to said diameter $D_1$ of said sports balls plus said first cross-sectional dimension of said shaft, and said second cross-sectional dimension of said sleeve equal to said second cross-sectional dimension of said shaft;

an upper pair of parallel spaced apart circular openings in said first cross-sectional dimension of said sleeve, said openings having a diameter $D_2$ smaller than said diameter $D_1$ of said sports balls;

a lower pair of parallel spaced apart circular openings in said first cross-sectional dimension of said sleeve, said openings having a diameter $D_2$ smaller than said diameter $D_1$ of said sports balls;

whereby said sports ball are inserted into an end of said sleeve and captured by said upper and lower pairs of spaced apart circular openings, and said sleeve and ball are removable fixed to said elongate shaft at said preselected position for mounting said sports balls.

11. The sports stick and ball package as in claim 10, said upper and lower pairs of parallel spaced apart circular openings in said first cross-sectional dimension of said sleeve having a diameter $D_2$ substantially equal to two times the square root of 0.25 times the diameter $D_1$ squared minus 0.25 times said second cross-sectional dimension of said sleeve squared.

12. The sports stick and ball package as in claim 11, said upper and lower pairs of parallel spaced apart circular openings in said first cross-sectional dimension of said sleeve having a diameter $D_2$ being positioned such that the centers of said circular openings are spaced inwardly from and perpendicular to said second cross-sectional dimension of said sleeve by a distance equal to one half said diameter $D_1$ of said sports ball.

13. The sports stick and ball package as in claim 10, said sports head being a hockey blade and said pair of sports balls being hockey balls.

14. The sports stick and ball package as in claim 10, said rectangular flexible sleeve being fabricated from thin sheet material selected from the group consisting of synthetic vellum, polyethylene terephthalate, and cardboard.

15. The sports stick and ball package as in claim 10, said sports head having a socket to receive said shaft, said preselect position for mounting said pair of sports balls being directly beneath said socket, and said rectangular flexible sleeve further including a tab extension secured within said socket to lock said sports balls and sleeve at said preselect position on said shaft.

16. The sports stick and ball package as in claim 15, said tab extension being joined to said flexible sleeve by a perforated line of severance to permit removal of said pair of sports balls and sleeve.

17. The sports stick and ball package as in claim 10, said sports head being a hockey blade, and said elongate shaft being rectangular in cross-section with said first cross-sectional dimension representing the width of said shaft and said second cross-sectional dimension representing the depth of said shaft.

* * * * *